US005123778A

United States Patent [19]

Bohnhoff

[11] Patent Number: 5,123,778

[45] Date of Patent: Jun. 23, 1992

[54] METHOD OF PAVING

[76] Inventor: William W. Bohnhoff, 12501 E. Amherst Cir., Aurora, Colo. 80014

[21] Appl. No.: 588,455

[22] Filed: Sep. 26, 1990

[51] Int. Cl.[5] ..... E01C 3/00; E01C 5/18

[52] U.S. Cl. ..... 404/28; 404/31; 404/32

[58] Field of Search ..... 404/72-74, 404/81, 83, 31, 28, 30

[56] References Cited

U.S. PATENT DOCUMENTS

| | | | |
|---|---|---|---|
| 70,076 | 10/1864 | Dean . | |
| 1,071,091 | 8/1913 | Rogers . | |
| 1,705,067 | 3/1929 | Sadtler | 404/28 |
| 1,905,176 | 4/1933 | Kieckhefer . | |
| 2,179,019 | 11/1939 | Willets | 404/31 |
| 2,315,180 | 3/1943 | Arthur . | |
| 2,315,448 | 3/1943 | Nagin et al. . | |
| 2,369,412 | 2/1945 | Ruppel . | |
| 2,672,793 | 3/1954 | Rowe et al. | 404/31 |
| 2,718,829 | 9/1955 | Seymour et al. | 404/31 |
| 2,876,628 | 3/1959 | Dixon, Jr. . | |
| 2,899,775 | 8/1959 | Partin . | |
| 2,912,910 | 11/1959 | Wilson et al. . | |
| 3,597,928 | 8/1971 | Pilaar . | |
| 3,903,702 | 9/1975 | Appleton . | |
| 3,909,144 | 9/1975 | Garn et al. | 404/31 |
| 3,990,247 | 11/1976 | Palmer . | |
| 4,067,197 | 1/1978 | Ritter . | |
| 4,111,585 | 9/1978 | Mascaro . | |
| 4,397,899 | 8/1983 | Marsh et al. | 404/28 X |
| 4,797,026 | 1/1989 | Webster | 404/31 X |
| 4,801,217 | 1/1989 | Goldberg | 404/28 X |
| 4,850,738 | 6/1989 | Niemi | 404/31 |
| 4,945,697 | 8/1990 | Ott et al. | 404/31 X |

FOREIGN PATENT DOCUMENTS

| | | | |
|---|---|---|---|
| 580651 | 7/1931 | Fed. Rep. of Germany | 404/30 |
| 379015 | 6/1907 | France | 404/28 |
| 36958 | 7/1935 | Netherlands | 404/30 |
| 676764 | 8/1952 | United Kingdom . | |

*Primary Examiner*—Thuy M. Bui
*Assistant Examiner*—Nancy P. Connolly

[57] ABSTRACT

A method of paving and resurfacing, with paving materials consisting of a matrix of particulate materials and a binder, utilizes a mat including a fabric layer with a plurality of rigid, upstanding tubular members spaced in a uniform array of staggered rows. When asphalt paving materials are employed, a conventional base layer is first coated by an asphaltic binder material. The mat is then spread over the binder material. A top layer of asphaltic paving material is applied over the mat, to a level above the tubular members. The top layer is then compacted within and around the tubular members. The mat may be applied selectively in only high volume traffic lane portions to minimize paving costs. The mat inhibits subsequent migration of the asphalt due to high temperatures and heavy loading. Other paving materials, of the type consisting of a matrix of particulate materials selected from the group of sand, gravel, crushed rock and crushed shell, and a granular binder selected from the group of lime, cement, and soil cement, may also be employed in conjunction with the mat. When such non-asphaltic paving mixtures are employed, the mat may be secured to the base layer by mechanical fasteners.

64 Claims, 2 Drawing Sheets

METHOD OF PAVING

BACKGROUND OF THE INVENTION

The present invention relates to methods of paving, and more particularly pertains to an improved method of paving utilizing paving materials consisting of a matrix of particulate materials and a binder. One paving material of this type, known as asphalt paving, consists of a matrix formed by a thermoplastic binder coating various gradations of sand and gravel size particles. In hot weather, the binder can become softened and allow the matrix to migrate, especially if the pavement is also subjected to high traffic volume, heavily loaded vehicles, or dynamic loads generated by stopping actions of vehicles. After relatively short amounts of time, new pavements will form ruts where the majority of vehicle tires are aligned within each lane. As time passes, ruts can deepen and cause a large number of problems for motorists. These problems include difficulty in changing lanes safely, discomfort to vehicle occupants and possible damage to vehicles crossing ruts at road intersections, a tendency for storm waters to pond within the ruts due to a lack of cross-drainage, and difficulty in snow and ice removal due to the lack of full contact of snowplow blades with the uneven pavement surface.

One prior art resurfacing method directed to this rutting problem entails the steps of grinding away excess asphalt material above a uniform vertical level of the road and recycling the removed asphalt material into a new overlay. The length of time between required overlays will remain relatively brief, unless a reduction in traffic occurs, or a higher quality paving material is employed.

Another prior art paving method directed to the extension of pavement life involves the careful and precise installation of an "anti-rut" asphalt mixture. The effective implementation of this method requires a high degree of quality control in the selection of proper ratios of graded aggregate and also in the associated application of the asphalt matrix, resulting in high paving costs. The selected aggregate in the asphalt matrix might have the physical characteristics to "lock" itself together, but the matrix still depends on the binder for resistance to lateral migration. Thus, migration and resultant rutting still occur when high temperatures soften the binder.

Geotextile and geogrid layers applied between the base and overlay in prior art paving methods are helpful in reducing overall pavement thickness and preventing potholes, but do little to prevent migration of the overlay mixture.

Other types of conventional paving materials consist of sand, gravel, or crushed shell in combination with a granular binder material of lime, cement, or soil cement. These materials are deposited on a road base in a dry or moist condition and then highly compacted. The bonding of the particulate materials depends upon a chemical reaction of the binder, which occurs gradually over time. Thus, this type of paving material is susceptible to migration before full bonding of the matrix has been achieved. These paving materials, while not softened by heat, are especially prone to migration when wet, and/or under heavy loads, resulting in the previously discussed rutting problems.

SUMMARY OF THE INVENTION

The present invention provides an improved method of paving and resurfacing, with paving materials consisting of a matrix of particulate materials and a binder, utilizing a mat including a fabric layer with a plurality of rigid, upstanding tubular members spaced in a uniform array of staggered rows. When asphalt paving materials are employed, a conventional base layer is first coated by an asphaltic binder material. The mat is then spread over the binder material. A top layer of asphaltic paving material is applied over the mat, to a level above the tubular members. The top layer is then compacted within and around the tubular members. The mat may be applied selectively in only high volume traffic lane portions to minimize paving costs. The mat inhibits subsequent migration of the asphalt due to high temperatures and heavy loading. Other paving materials, of the type consisting of a matrix of particulate materials selected from the group of sand, gravel, crushed rock, and crushed shell, and a granular binder selected from the group of lime, cement, and soil cement, may also be employed in conjunction with the mat. When such non-asphaltic paving mixtures are employed, the mat may be secured to the base layer by mechanical fasteners.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
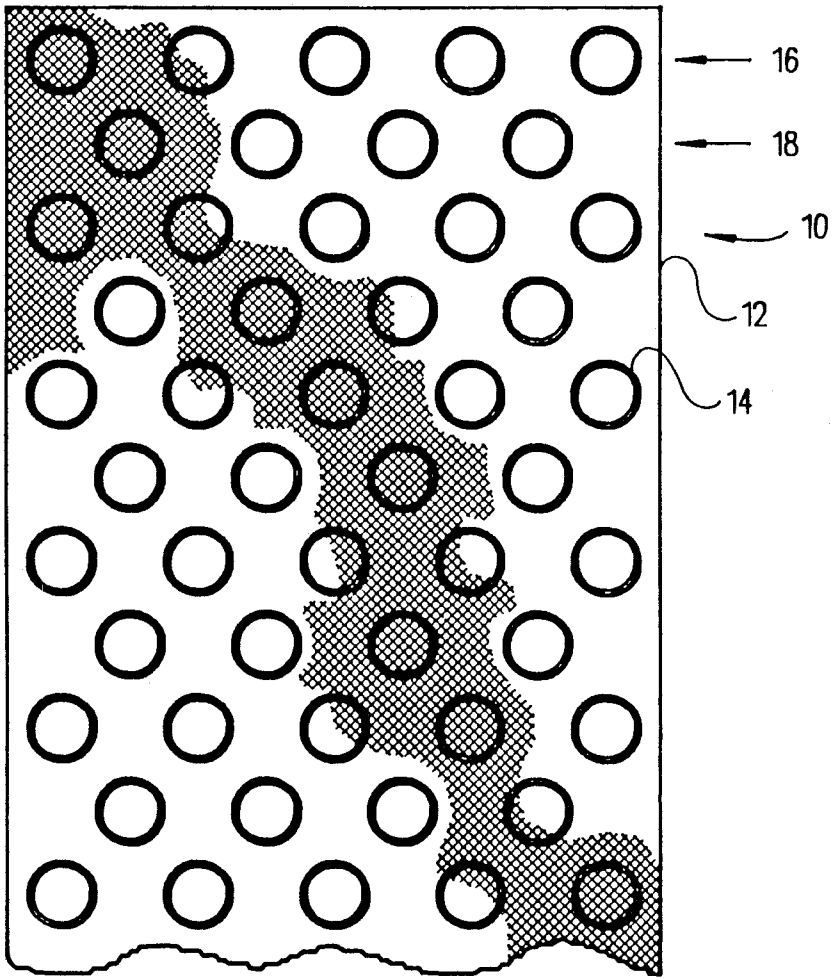
FIG. 1 is a top plan view of the mat utilized in the paving method according to the present invention.
Figure 5:
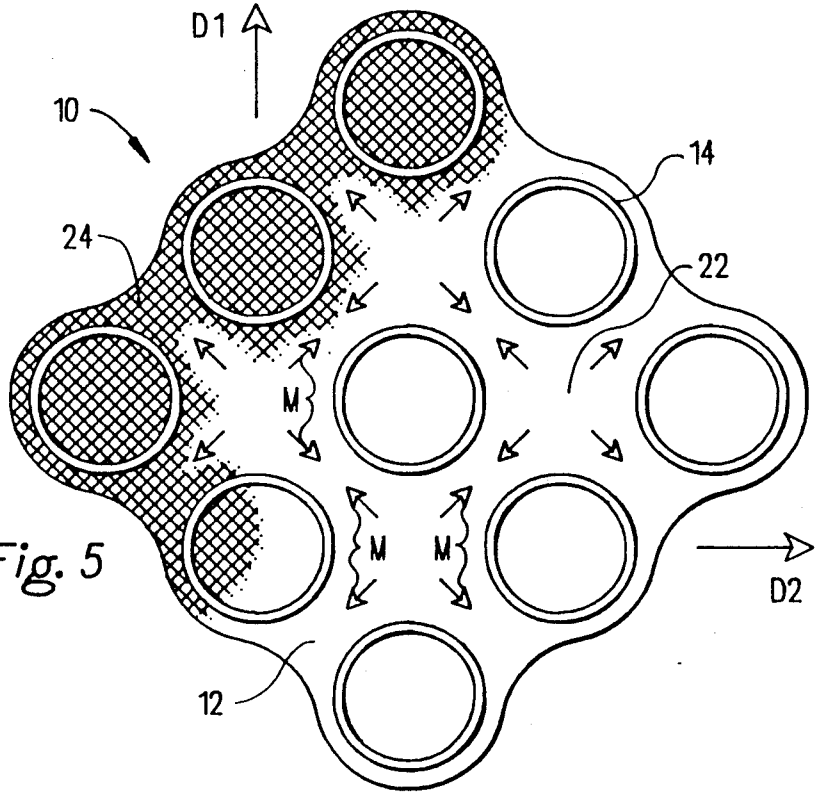
FIG. 5 is a diagrammatic top plan view illustrating the orientation of the upstanding tubular members on the mat and the resulting inhibition of asphalt migration.

Referring now to the drawings, wherein like reference numerals designate corresponding structure throughout the views, and referring in particular to FIG. 1, an improved method of paving according to a first preferred embodiment of the invention utilizes a mat 10 including a fabric layer 12. The fabric layer 12 may be formed from woven or non-woven fabric materials. One suitable woven material is polyester. A suitable non-woven material is a heat calendared geotextile sold under the name TYPAR 3401 (tm), manufactured by DUPONT (tm). A non-woven material has characteristics similar to standard underlayment fabric, and prevents cracks in a base layer from propagating upwardly into the overlayment. A woven mesh material may be employed to allow direct contact between the base and overlayment layers, and also provide a strong horizontal plane for load transfer. If a woven mesh fabric material is utilized to form the layer 12, as illustrated in FIG. 5, the asphalt forming the overlayment 32 directly bonds with the asphalt forming the intermediate layer 28 shown in FIG. 3, through the spaces in the mesh.

A plurality of upstanding tubular members 14 are disposed in a uniform array of staggered rows on the top surface of the fabric layer 12. As shown, the tubular members 14 are arranged in a plurality of laterally extending rows, spaced along the length of the layer 12. The tubular members 14 of each adjacent row are slightly laterally offset or staggered, as shown between rows 16 and 18. As a result of this offset or stagger, the tubular members 14 of the row 18 are disposed substantially midway between the tubular members 14 of the row 16.

The tubular members 14 may take the form of the illustrated cylindrical rings, or a variety of other geometrical shapes, for example, those having transverse cross-sectional shapes that are square, hexagonal, triangular, rectangular, etc. The dimensions of the tubular members 14 may vary depending upon the intended application and the selected resin material employed in the manufacture of the tubular members 14. For example, cylindrical rings may be employed having a diameter of three inches, a height of one inch and a wall thickness sufficient to bear the intended applied loads. Smaller diameter rings may be employed, but must be placed more closely together to effectively inhibit migration of the paving material matrix. Additionally, larger diameter rings may be employed, although larger rings reduce the ease with which the mat 10 may be rolled, and also increase the amount of required material and resultant paving costs. The dimensions and spacing of each of the members 14 should be selected such that at least twenty percent of the surface area of the top surface of the fabric layer 12 is enclosed within the tubular members.

The tubular members 14 may be formed from a variety of engineering resin materials such as polypropylene, polyethylene, or polycarbonate materials. Appropriate materials utilized in the formation of the tubular members 14 preferably have a melting point above three-hundred and fifty degrees Fahrenheit, so as to maintain rigidity during application and compaction of the asphalt matrix, when asphaltic paving materials are employed.

Figure 2:
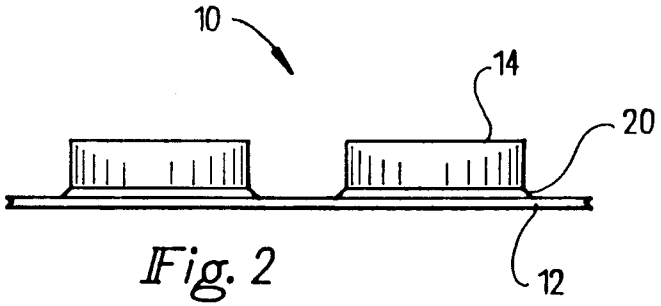
FIG. 2 is a partial side elevational view illustrating the mat.

The tubular members 14 have a uniform vertical extent above the upper surface of the fabric layer 12, as shown in FIG. 2. The tubular members 14 are secured to the fabric layer 12 by an adhesive 20, or by other mechanical bonding methods or fasteners.

The adhesive 20 utilized to secure the tubular members 14 to the fabric layer 1 is also selected to retain strength at temperatures above three-hundred and fifty degrees Fahrenheit. One suitable class of adhesives are polyolefin hot-melt type adhesives.

Figure 3:
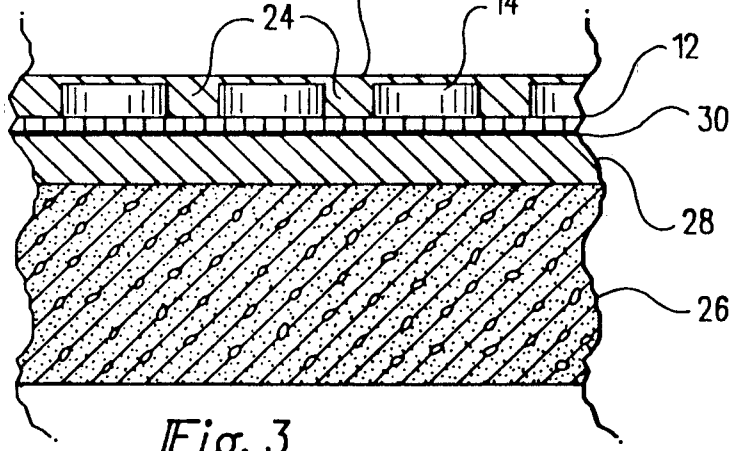
FIG. 3 is a partial vertical cross-sectional view illustrating a roadway formed by the paving method of the present invention.

With reference now to FIG. 3, the method of paving utilizing the mat 10 of FIGS. 1 and 2 will now be described. The paving method of the present invention may be utilized on highways, streets, intersections, bus stops, parking lots, airport runways, and similar applications. A standard base or road bed 26 may be formed from sand, gravel, compacted earth, concrete, or asphalt. An intermediate layer 28 of a paving material such as concrete, asphalt, or a matrix consisting of particulate material and a granular binder, is applied in a conventional manner to the base layer 26. A binder material 30, for example, a conventional asphalt binder material, is then applied to the surface of the intermediate layer 28, if an asphaltic paving material is employed, for example, utilizing conventional spray application techniques.

If an non-asphaltic paving material is employed, for example a paving material consisting of a matrix of particulate material selected from the group of sand, gravel, crushed rock and crushed shell, and a granular binder selected from the group of lime, cement, and soil cement, the binder material 30 may be omitted, and mechanical fasteners may be employed.

While the binder material 30 is wet, the fabric layer 12 is spread thereon. It is contemplated that the mat 10 shown in FIG. 1 may be provided in an initially rolled condition, such that the mat 10 may be applied by unrolling from a vehicle during the paving operation. The binder material 30 is absorbed by the fabric layer 12, thus securing it in place. The tubular members 14 secured to the mat 12 are thus disposed in an upwardly directed orientation.

Figure 6:
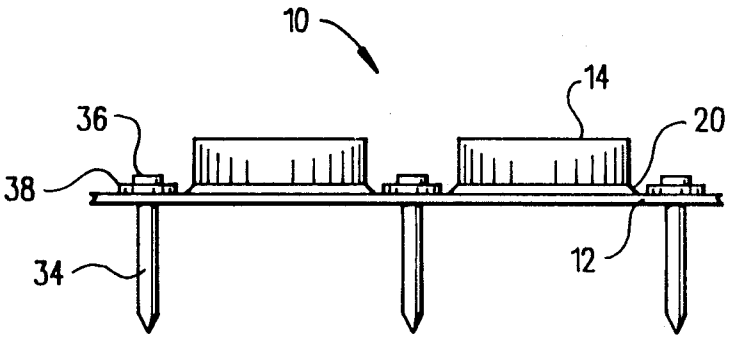
FIG. 6 is a partial side elevational view illustrating the mat and mechanical fasteners for securing the mat to a road base layer.

As shown in FIG. 6, mechanical fasteners may be utilized to secure the mat 10 in position, especially when non-asphaltic paving materials are employed. The mechanical fasteners may take the form of nails or spikes having pointed shanks 34 and enlarged heads 36. Washers 38 interposed between the heads 36 and the fabric layer 12 prevent the heads 36 from pulling through the fabric layer 12.

A top layer 32 of an asphaltic paving material is then applied over the fabric layer 12 to a level above the top surface of the tubular members 14, such that the asphalt 32 surrounds and fills each of the tubular members 14. The top asphalt layer 32 is then compacted utilizing conventional equipment and techniques.

If non-asphaltic paving materials are employed, they are compacted in a similar manner between and within the tubular members 14. It should be understood that the degree of compaction is very high, at least 95% of maximum density of the paving material.

It is important to note that the paving method of the invention may be employed in resurfacing existing road-ways and other surfaces, as well as during initial construction.

Figure 4:
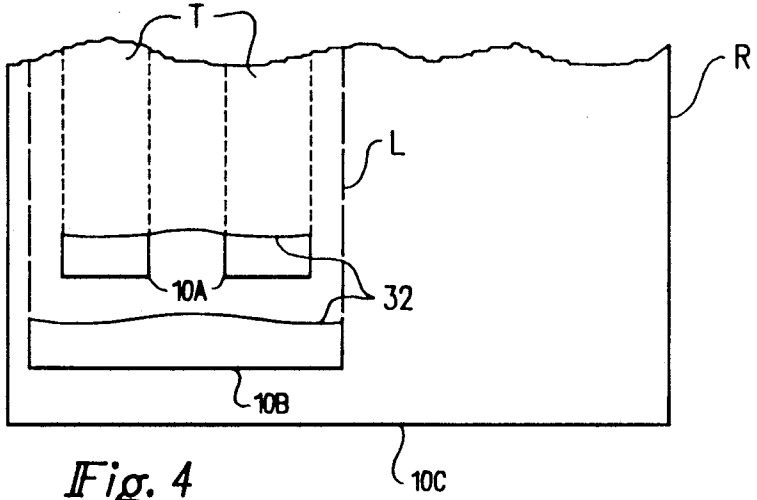
FIG. 4 is a top plan view, partially cut-away, illustrating various alternative mat placements and widths useable in the method of paving according to the present invention.

As shown in FIG. 4, a typical road R includes a high wear lane portion L in which tire ruts T are formed over time. In order to minimize paving costs, the mat 10 may be employed in the form of narrow elongated strips positioned in alignment with the portions of the road R in which the tire ruts T normally form, as illustrated at 10A. Alternatively, the mat 10 may be formed in a width to extend across the high traffic lane portion L of the road R, as illustrated at 10B. Finally, the mat 10 may be formed with a width to extend substantially entirely across the entire surface of the road R, as illustrated at 10C. It should also be noted that the mat 10 may be applied in a plurality of adjacent strips or sections, as opposed to a single width mat.

During subsequent use of the road R, or other paved surface, vehicle tires apply a downward force on the overlayment asphalt layer 32, or on the top surface of the compacted paving material, in the case of use of non-asphaltic paving materials. These forces can result in lateral migration of the asphalt forming the overlayment 32, or particulate material and granular binder matrix in non-asphaltic paving materials, in conventional paving methods. However, as illustrated diagrammatically in FIG. 5, the mat 10 utilized in the paving method of the present invention inhibits this migration. Arrow D1 indicates the linear direction of travel of vehicles along the mat 10. It is a desirable aspect of the invention that there are no continuous linear passages extending between the tubular members 14 which are both parallel to the plane of the layer 12 (and the surface intended to be paved) and either substantially parallel (extending in direction D1) or substantially perpendicular (extending in direction D2) to a direction D1 of vehicle travel over the surface of the layer 12, due to the staggered spacing of the rows of tubular members 14 on the layer 12.

Asphalt of the overlayment 32, or alternatively non-asphaltic paving material, is disposed both within the tubular members 14, within interstitial spaces or pockets 22 between the tubular members, and in the spaces 24 separating the tubular members 14. Arrows M illustrate the very limited resulting migration routes available for the asphalt forming the overlayment 32, or non-asphaltic paving material, between the tubular members 14, possible only as traffic wears away the material of the tubular members 14, and asphaltic overlayment 32, to decrease vertical elevation. Even with this wear taking place however, the service life of the overlay areas utilizing the mat 10 will be greatly extended.

It is to be understood, however, that even though numerous characteristics and advantages of the present invention have been set forth in the foregoing description, together with details of the method, structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of paving, comprising the steps of:

depositing a layer of binder material on a surface to be paved;

disposing a mat on said layer of binder material, said mat including a plurality of substantially rigid, spaced, upstanding tubular members, each substantially perpendicularly secured to a substantially planar flexible fabric layer; and covering said mat with an asphaltic paving mixture.

2. The method of claim 1, further comprising the steps of covering said mat with said asphaltic paving material to a level above said tubular members.

3. The method of claim 1, further comprising the step of substantially filling said tubular members with said asphaltic paving mixture.

4. The method of claim 1, further comprising the step of substantially surrounding said tubular members with said asphaltic paving mixture.

5. The method of claim 1, further comprising the step of substantially filling and substantially surrounding said tubular members with the said asphaltic paving mixture.

6. The method of claim 1, wherein said binder material is an asphaltic material.

7. The method of claim 1, wherein said fabric layer comprises a woven material.

8. The method of claim 1, wherein said fabric layer comprises a non-woven material.

9. The method of claim 1, wherein said tubular members are formed from a plastic material.

10. The method of claim 1, wherein said tubular members are adhesively secured to said fabric layer.

11. The method of claim 1, wherein said tubular members are uniformly spaced on said fabric layer.

12. The method of claim 1, wherein said tubular members enclose substantially at least twenty percent of surface area of said fabric layer.

13. The method of claim 1, further comprising the step of compacting said paving mixture within and around said tubular members.

14. The method of claim 1, wherein said tubular members are substantially cylindrical.

15. The method of claim 1, further comprising the step of spacing said tubular members on said fabric layer such that there are essentially no continuous linear passages extending between said tubular members which are both substantially parallel to the surface to be paved and either substantially parallel or substantially perpendicular to the primary direction of vehicle travel over the surface.

16. The method of claim 1, further comprising the step of spacing said tubular members on said fabric layer in staggered rows such that there are essentially no continuous linear passages extending between said tubular members which are both substantially parallel to the surface to be paved and either substantially parallel or substantially perpendicular to the primary direction of vehicle travel over the surface.

17. A method paving, comprising the steps of:

spreading a mat including a plurality of spaced, substantially rigid upstanding tubular members, each substantially perpendicularly secured to a substantially planar flexible fabric layer, on a surface to be paved; and covering said mat with an asphaltic paving mixture.

18. The method of claim 17, further comprising the step of covering said mat with said asphaltic paving mixture to a level above said tubular members.

19. The method claim 17, further comprising the step of substantially filling said tubular members with said asphaltic paving mixture.

20. The method of claim 17, further comprising the step of substantially surrounding said tubular members with said asphaltic paving mixture.

21. The method of claim 17, further comprising the step of substantially filling and substantially surrounding said tubular members with said asphaltic paving mixture.

22. The method of claim 17, wherein said fabric layer comprises a woven material.

23. The method of claim 17, wherein said fabric layer comprises a non-woven material.

24. The method of claim 17, wherein said tubular members are formed from a plastic material.

25. The method of claim 17, wherein said tubular members are adhesively secured to said fabric layer.

26. The method of claim 17, wherein said tubular members are substantially uniformly spaced on said fabric layer.

27. The method of claim 17, wherein said tubular members enclose substantially at least twenty percent of surface area of said fabric layer.

28. The method of claim 17, further comprising the step of compacting said paving mixture within and around said tubular members.

29. The method of claim 17, wherein said tubular members are substantially cylindrical.

30. The method of claim 17, further comprising the step of spacing said tubular members on said fabric layer such that there are essentially no continuous linear passages extending between said tubular members which are both substantially parallel to the surface to be paved and either substantially parallel or substantially perpendicular to the primary direction of vehicle travel over the surface.

31. The method of claim 17, further comprising the step of spacing said tubular members on said fabric layer in staggered rows such that there are essentially no continuous linear passages extending between said tubular members which are both substantially parallel to the surface to be paved and either substantially parallel or substantially perpendicular to the primary direction of vehicle travel over the surface.

32. A method of resurfacing an existing paved surface, comprising the steps of:

depositing a layer of binder material on said existing paved surface;

depositing a mat including a plurality of spaced, substantially rigid tubular members, each substantially perpendicularly secured to a substantially planar flexible fabric layer, on said layer of binder material to at least partially cover said existing paved surface; and covering said fabric layer with an asphaltic material.

33. The method of claim 32, further comprising the step of compacting said asphaltic paving material within and around said tubular members.

34. The method of claim 32, further comprising the step of covering said mat to a level above said tubular members.

35. The method of claim 32, further comprising the step of spacing said tubular members on said fabric layer such that there are essentially no continuous linear passages extending between said tubular members which are both substantially parallel to the surface to be paved and either substantially parallel or substantially perpendicular to the primary direction of vehicle travel over the surface.

36. The method of claim 32, further comprising the step of spacing said tubular members on said fabric layer in staggered rows such that there are essentially no continuous linear passages extending between said tubular members which are both substantially parallel to the surface to be paved and either substantially parallel or substantially perpendicular to the primary direction of vehicle travel over the surface.

37. A method of paving a road surface having lane portions exposed to high traffic volume contact with vehicle tires, comprising the steps of:

spreading at least one mat to substantially cover said lane portions exposed to high traffic volume contact with vehicle tires, said mat including a plurality of spaced, substantially rigid upstanding tubular members, each substantially perpendicularly secured to a substantially planar flexible fabric layer; and covering said road surface and said mat with an asphaltic paving mixture.

38. The method of claim 37, further comprising the step of compacting said asphaltic paving material within and around said tubular members.

39. The method of claim 37, further comprising covering said mat to a level above said tubular members.

40. The method of claim 37, further comprising the step of spacing said tubular members on said fabric layer such that there are essentially no continuous linear passages extending between said tubular members which are both substantially parallel to the surface to be paved and either substantially parallel or substantially perpendicular to the primary direction of vehicle travel over the surface.

41. The method of claim 37, further comprising the step of spacing said tubular members on said fabric layer in staggered rows such that there are essentially no continuous linear passages extending between said tubular members which are both substantially parallel to the surface to be paved and either substantially parallel or substantially perpendicular to the primary direction of vehicle travel over the surface.

42. A method of paving, comprising the steps of:

providing a mat including a substantially uniform array of upstanding, spaced, substantially rigid tubular members, each substantially perpendicularly secured to a substantially planar flexible fabric layer;

spreading said mat upon a surface to be paved, with said tubular members extending upwardly from said fabric layer;

covering said fabric layer with an asphaltic paving mixture to a level above said tubular members; and compacting said asphaltic paving mixture within and around said tubular members such that subsequent migration of said asphaltic paving mixture is inhibited.

43. The method of claim 42, further comprising the step of depositing a layer of a binder material on said surface to be paved prior to spreading said fabric layer.

44. The method of claim 42, wherein said tubular members are substantially cylindrical.

45. The method of claim 42, wherein said tubular members enclose substantially at least twenty percent of surface area of said fabric layer.

46. The method of claim 42, wherein said fabric layer comprises a woven material.

47. The method of claim 42, wherein said fabric layer comprises a non-woven material.

48. The method of claim 42, wherein said tubular members are adhesively bonded to said fabric layer.

49. The method of claim 42, further comprising the step of spacing said tubular members on said fabric layer such that there are essentially no continuous linear passages extending between said tubular members which are both substantially parallel to the surface to be paved and either substantially parallel or substantially perpendicular to a direction of vehicle travel over the surface.

50. The method of claim 42, further comprising the step of spacing said tubular members on said fabric layer in staggered rows such that there are essentially no continuous linear passages extending between said tubular members which are both substantially parallel to the surface to be paved and either substantially parallel or substantially perpendicular to a direction of vehicle travel over the surface.

51. A method of paving, comprising the steps of:

providing a mat including a plurality of spaced, substantially rigid, upstanding tubular members, each substantially perpendicularly secured to a substantially planar flexible fabric layer;

spreading said fabric layer upon a surface to be paved, with said tubular members extending upwardly from said fabric layer;

covering said mat with a paving mixture including particulate material and a binder; and compacting said paving mixture within and around said tubular members such that subsequent migration of said paving mixture is inhibited.

52. The method of claim 51, wherein said binder material is a granular material.

53. The method of claim 52, wherein said binder material is selected from the group consisting of lime, cement, and soil cement.

54. The method of claim 51, wherein said particulate material is selected from the group consisting of gravel, sand, crushed rock, and crushed shell.

55. The method of claim 51, further comprising the step of securing said mat to said surface to be paved by at least one mechanical fastener.

56. The method of claim 51, further comprising the step of securing said mat to said surface to be paved by extending at least one mechanical fastener through said mat and into said surface to be paved.

57. The method of claim 51, wherein said step of compacting said paving mixture includes the step of compacting said paving mixture to not less than 95 percent of the maximum density of the paving mixture after deposition on said mat.

58. The method of claim 51, wherein said tubular members are substantially cylindrical.

59. The method of claim 51, wherein said tubular members enclose substantially at least twenty percent of surface area of said fabric layer.

60. The method of claim 51, wherein said fabric layer comprises a woven material.

61. The method of claim 51, wherein said fabric layer comprises a non-woven material.

62. The method of claim 51, wherein said tubular members are adhesively bonded to said fabric layer.

63. The method of claim 51, further comprising the step of spacing said tubular members on said fabric layer such that there are essentially no continuous linear passages extending between said tubular members which are both substantially parallel to the surface to be paved and either substantially parallel or substantially perpendicular to a direction of vehicle travel over the surface.

64. The method of claim 51, further comprising the step of spacing said tubular members on said fabric layer in staggered rows such that there are essentially no continuous linear passages extending between said tubular members which are both substantially parallel to the surface to be paved and either substantially parallel or substantially perpendicular to a direction of vehicle travel over the surface.

* * * * *